US005397029A

United States Patent [19]

West

[11] Patent Number: 5,397,029

[45] Date of Patent: Mar. 14, 1995

[54] PERSONAL PROTECTION DEVICE

[76] Inventor: William D. West, 5141 Oakdale Ct., Douglasville, Ga. 30135

[21] Appl. No.: 197,398

[22] Filed: Feb. 16, 1994

[51] Int. Cl.[6] ..... F41H 13/00

[52] U.S. Cl. ..... 222/79; 222/153; 222/162; 222/325; 222/402.11; 222/509

[58] Field of Search ..... 222/3, 402.11, 78, 79, 222/162, 183, 402.13, 402.15, 192, 174, 509, 153, 325

[56] References Cited

U.S. PATENT DOCUMENTS

| | | | |
|---|---|---|---|
| 3,602,399 | 8/1971 | Litman et al. | 222/79 X |
| 3,619,930 | 10/1971 | Beermann et al. . | |
| 3,635,374 | 1/1972 | Anketell | 222/78 |
| 3,730,390 | 5/1973 | Adrian | 222/79 |
| 3,756,467 | 9/1973 | Anketell | 222/78 |
| 3,776,429 | 12/1973 | DeLucia | 222/162 |
| 3,841,526 | 10/1974 | Haskins | 222/79 |
| 4,223,804 | 9/1980 | Morris et al. | 222/3 |
| 4,402,430 | 9/1983 | Fox et al. | 222/183 |
| 4,449,474 | 5/1984 | Mariol | 116/2 |
| 5,088,624 | 2/1992 | Hackett et al. | 222/162 X |

FOREIGN PATENT DOCUMENTS

| | | | |
|---|---|---|---|
| 2671294 | 7/1992 | France | 222/79 |
| 2741237 | 3/1979 | Germany | 222/162 |

*Primary Examiner*—Kevin P. Shaver
*Attorney, Agent, or Firm*—Kenneth S. Watkins, Jr.

[57] ABSTRACT

A personal protection device is disclosed which utilizes a pressurized canister of non-lethal gas. The device comprises a barrel for holding the canister, a trigger, and a handle for holding and aiming the device. The handgun shape of the device results in strong tactile cues for quickly and accurately discharging the device. In the preferred embodiment, the barrel pivots for quickly loading and unloading. A compartment is provided in the handle for storing a spare cartridge. A safety is disclosed to prevent inadvertent discharge of the device.

10 Claims, 4 Drawing Sheets

PERSONAL PROTECTION DEVICE

BACKGROUND

The present invention relates to a personal protection device, specifically a non-lethal gas dispensing device.

Increasing crime rates and the increased publicity of violent crime has created a heightened public awareness of violent crime. Daily reports on television and radio of assaults, armed robberies, muggings, rapes, and murders testify to the problem. Many individuals are concerned, even frightened, at the prospect of violent crime directed at them as well as friends, families, or loved ones.

Many law abiding individuals, fearful of the threat and fed up with law enforcement's inability to cope with the problem, have resorted to gun ownership. Although gun ownership and possession may make the individual feel safer, studies show this may not be a solution. One recent study indicated handgun ownership in the home actually increased the possibility of the gun owner being killed with a handgun.

The prospect of ever increasing numbers of weapons, especially handguns, in our society has led to an increasing movement toward stronger gun control measures. However, this does little to belay the fears of many since they believe criminals will continue to gain access to these deadly weapons.

These gloomy facts have intensified the search for effective alternatives to handguns as protection from violent crime. One of the most effective measures gaining in popularity is the use of non-lethal gas to deter a violent attack. Tear gas, and various other irritating or debilitating gasses have been used successfully. Pepper gas has been especially popular due to its immediate debilitating effects to the eyes, skin, and breathing passages, and yet the gas creates no long term harmful effects to the affected individual.

The use of these products are welcomed by those who are opposed to lethal means to deter crime, and by those who fear the use of the protection device on themselves or other innocent persons. Law enforcement personnel prefer the use of non-lethal gas to handguns by individuals due to the reduced risk of injury or death to themselves as well as innocent bystanders. The use of a marker such as dyes in the gas can actually aid in the apprehension of criminals. Probably the greatest advantage of the use of non-lethal gas over handguns is the reduction of deaths of many innocent persons, killed accidentally each year.

Up to now, non-lethal gas dispensers have suffered drawbacks which limit their acceptance and effectiveness. The most common gas dispenser is a pressurized canister with an integral nozzle valve at one end. The nozzle valve is activated by pressing a button on the nozzle valve with ones finger to release the gas. In this arrangement the direction of discharge is not intuitively obvious. One has only to recall use of spray cans for other products and realize how easy it is to spray in the wrong direction, even discharging on the user in some instances. Unique shapes to the canister or nozzle valve have helped but have not solved the problem.

Another limitation of the above device is inadvertent discharge of the device, especially in a pocket or purse where considerable damage to personal property is possible. The gas dispenser may be placed in a protective case to be made safe. Use of the device requires release of a case cover, or removal of the dispenser from the case, further slowing the use of the dispenser in an emergency. Mechanical safety latches have been integrated with the nozzle valve, but these tend to increase fumbling and add to the uncertainty of discharge direction.

Other devices have been disclosed to discharge a non-lethal gas in combination with other features. U.S. Pat. No. 4,223,804 to Morris et al. discloses a gas dispenser combined with a flashlight and Pat. No. 4,449,474 to Mariol discloses a gas dispenser which includes a flash device and a whistle. While these devices add features to a gas dispenser, they do not fully address all the shortcomings of simple canister dispensers. They also do not address the problem of providing a spare gas canister conveniently, to be used quickly if required.

Therefore, an object of this invention is to provide a personal protection device which uses readily available non-lethal gas canisters and provides a fast and reliable method of accurately aiming and discharging the gas, one that can be used by an individual with no fumbling or confusion.

A further object of this invention is to provide a gas dispenser which can be quickly loaded, unloaded and reloaded with standard non-lethal gas canisters.

Yet another object of this invention is to provide a gas dispenser which has an effective means to prevent inadvertent discharge of the device.

And still a further object of this invention is to provide a gas dispenser with a means for storing a spare gas canister in the device for convenience and safety.

SUMMARY

These and other objects are accomplished by my invention, a personal protection device which utilizes conventional pressurized non-lethal gas canisters. The device has a pistol shape resulting from the novel barrel, trigger, and handle. This pistol shape results in strong tactile recognition features by a user. This tactile recognition enables the user to very quickly aim and discharge the device with confidence and accuracy.

The personal protective device can be quickly and easily opened for quick removal of the spent gas canister and insertion of a new one. The preferred embodiment of the personal protective device also includes an effective safety device for preventing inadvertent discharge of the device. The storage chamber in the handle of the device conveniently stores a spare canister for quick employment if needed.

The device includes a barrel which receives a conventional non-lethal pressurized gas canister. The canister has an integral nozzle valve through which the gas is dispensed when the nozzle is depressed. The barrel holds the canister with the nozzle valve directed out the discharge end of the barrel. A trigger causes the nozzle valve to be depressed when the trigger is pulled, discharging the gas from the discharge end of the device. A handle is attached to the barrel to aid in holding, aiming, and discharging the device.

In its preferred embodiment, the barrel is connected to the handle by a pivot. When the barrel is pivoted to a loading position, the loading end of the barrel is exposed, allowing a canister to be inserted into the barrel. When the barrel is pivoted to the operating position, the canister is restrained in the barrel by a stop.

A nozzle engagement means, connected to the trigger, depresses the nozzle valve when the trigger is pulled, discharging the gas of the canister. A safety engages the trigger to prevent the trigger from being pulled and discharging the canister inadvertently. A chamber in the handle provides storage space for a spare canister. A recess for the nozzle valve in the storage space prevents the nozzle valve from being depressed and accidentally discharged. A cover over the spare canister chamber retains the spare canister and prevents dust and dirt from entering the chamber.

In an alternative embodiment, a canister is inserted into the loading end of the barrel. A spring loaded pawl engages the canister when it is inserted. The nozzle valve is restrained by a stop in the discharge end of the barrel. The trigger is connected to the spring loaded pawl so the canister is pushed towards the discharge end when the trigger is pulled. Because the nozzle valve is restrained by the stop, the nozzle valve is depressed by the motion of the canister, discharging the contents of the canister.

A release latch retracts the spring loaded pawl when activated, allowing removal of the spent canister from the loading end of the barrel. A cover over the loading end of the barrel protects the barrel from entry of dust and dirt.

BRIEF DESCRIPTION OF THE DRAWINGS

These and other features, aspects, and advantages of the present invention will become better understood with regard to the following description, appended claims, and accompanying drawings where:

DETAILED DESCRIPTION

A personal protective device will now be described which overcomes the shortcomings of previous non-lethal gas dispensers. The present invention can be quickly and accurately deployed and discharged, and has provisions for preventing inadvertent discharge of the canister, as well as provision for a spare canister stored in the device.

Figure 1:
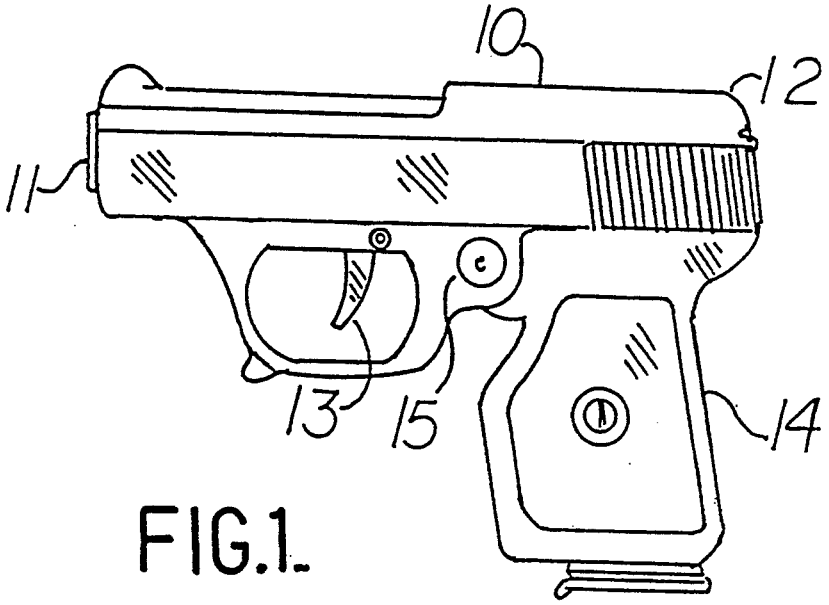
FIG. 1 is a side elevation drawing of the preferred embodiment of the present invention.

FIG. 1 is an elevation drawing of the preferred embodiment of the invention. A barrel or barrel means 10, having a shape generally as the barrel of a pistol, holds a non-lethal gas canister (not shown). Barrel 10 comprises a discharge end 11 and a loading end 12. A trigger or trigger means 13 activates the canister to discharge the non-lethal gas from the discharge end 11 of the device. Handle or handle means 14, having a shape generally as the handle of a pistol, is attached to the barrel 10 for holding and aiming the device. The novel features of the device, which will be further described, dictate the shape which is similar to a pistol. The strong tactile cues of the shape of the device, specifically the handle, barrel, and trigger arrangement allow the device to be quickly and accurately aimed and discharged, even in a stressful situation.

Pivot or pivot means 15 allows the barrel to be pivoted about the handle for quickly removing a discharged canister and loading a new canister.

Figure 2:
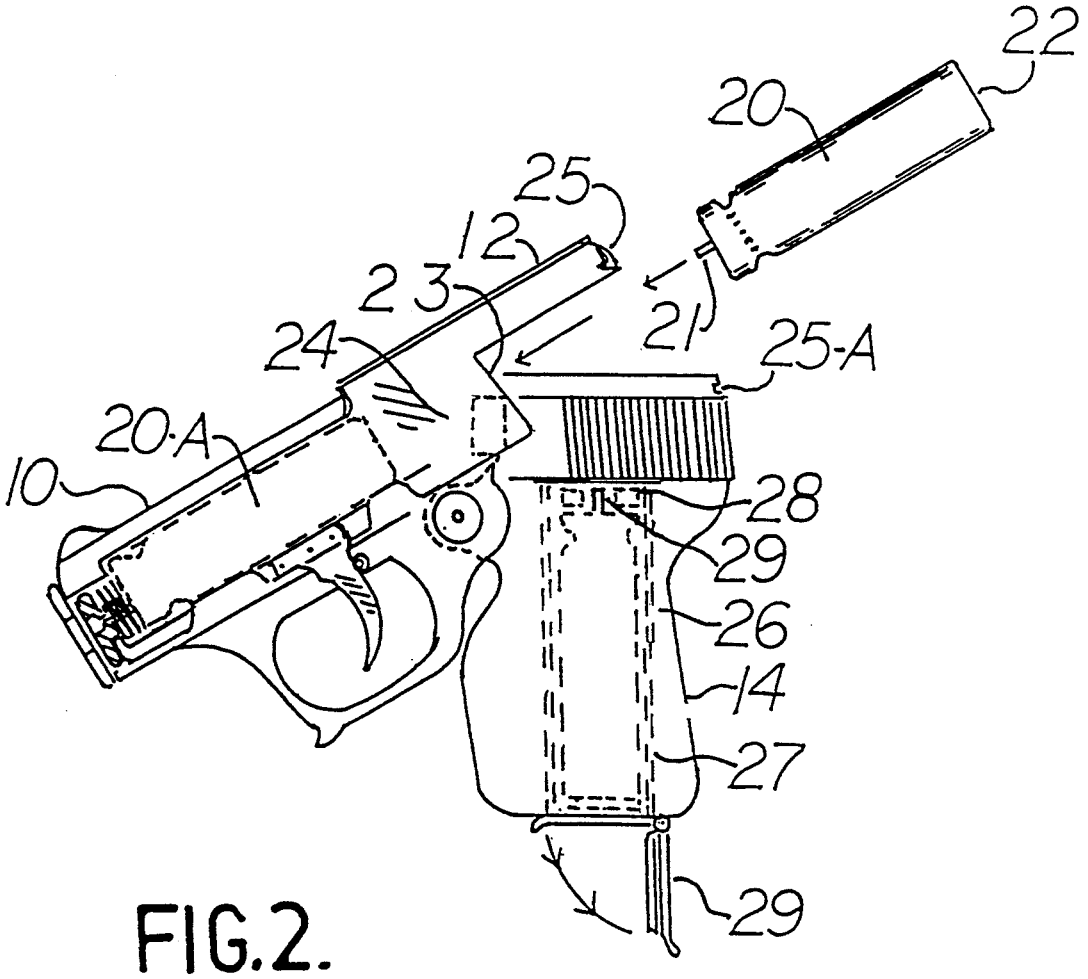
FIG. 2 is a side elevation drawing of the preferred embodiment in the loading position.

FIG. 2 shows the device in a loading position where barrel 10 forms an acute angle with handle 14. The device uses a pressurized non-lethal gas canister 20 with an integral nozzle valve 21. The contents of canister 20 are discharged when nozzle valve 21 is depressed toward the opposite end 22 of canister 20.

In the loading position, canister 20 can be inserted in the loading aperture 23 of barrel 10, to position 20*a*. Canister 20 is restrained by a restraining means comprising a front canister stop (30 of FIG. 3) and back canister stop 24 of handle 14 when the barrel is in the operating position. In the operating position, barrel 10 forms substantially a ninety degree angle with the handle as shown in FIG. 1. Spring clip 25 latches to detent 25*a* of handle 14 to retain barrel 10 in the operating position.

Spare canister 26 is stored in storage chamber 27 of handle 14. Nozzle valve receiving means or recess 28 in the end of chamber 27 prevents nozzle valve 29 from being depressed when canister 26 is inserted in chamber 27. Hinged cover 29 closes to retain spare canister 26 in chamber 27 and protect chamber 27 and spare canister 26 from dust and dirt. Cover 29 opens to remove spare canister 26.

Figure 3:
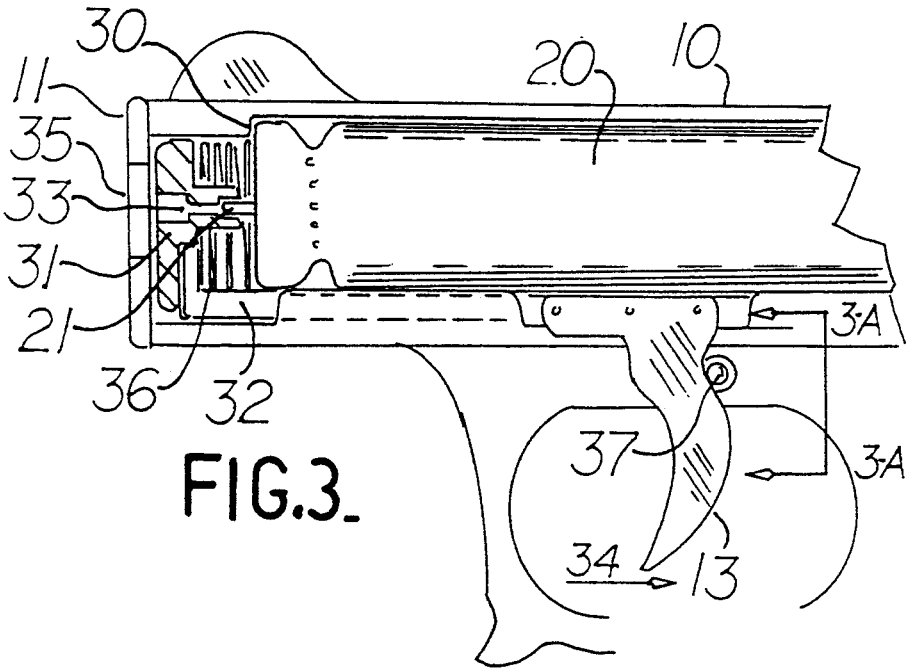
FIG. 3 is a detail elevation drawing of the discharge end of the barrel for the preferred embodiment.

FIG. 3 is a detail of the discharge end of barrel 10. Nozzle valve engagement means or nozzle cap 31 engages nozzle valve 21 of canister 20. A connecting means such as trigger bar 32 is connected to nozzle cap 31 and trigger 13 so that when trigger 13 is pulled in direction 34, nozzle cap 31 is pulled toward the loading end of barrel 10. Because canister 20 is restrained by back stop 24 (see FIG. 2), the motion of nozzle cap 31 depresses nozzle valve 21. Nozzle cap aperture 33 directs the gas from pressurized canister 20 through opening 35 of the discharge end 11 of barrel 10. Spring 37 biasses nozzle cap 31, trigger bar 32, and trigger 13 toward the discharge end 11 and aids in the removal of canister 20.

Figure 3A:
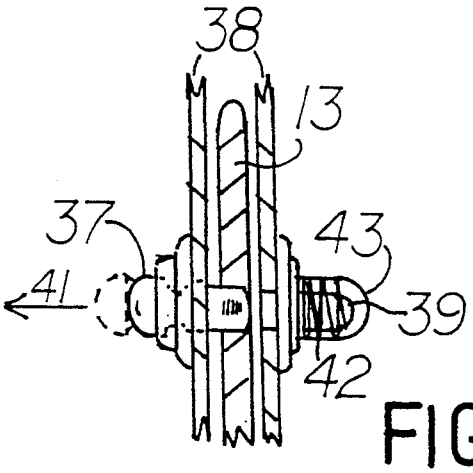
FIG. 3A is a section detail of the safety of FIG. 3.

Safety means or safety 37 is shown in section detail FIG. 3A. In its engaged position, safety 37 is inserted between trigger housing members 38 to prevent trigger 13 from being pulled in direction 34 and inadvertantly discharging canister 20. Safety 36 is moved to its unlatched position as shown in the phantom lines of FIG. 3A when safety release pin 39 is pushed in direction 41. Safety spring 42 retracts safety release pin 39 when released, and resilient cover 43 covers safety release pin 39.

Figure 4:
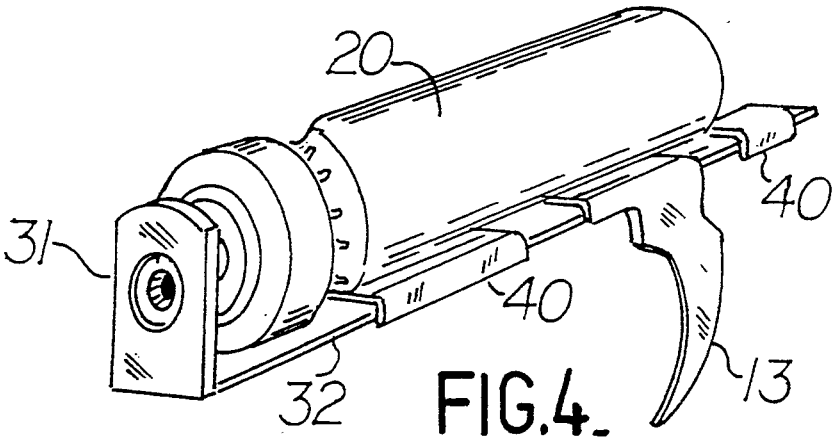
FIG. 4 is a perspective detail of the trigger and trigger bar of the preferred embodiment.

FIG. 4 is a perspective detail of trigger 13, trigger bar 32 and nozzle cap 31. Trigger bar guides 40 are connected to barrel 10 and allow sliding motion of trigger bar 32.

Figure 5:
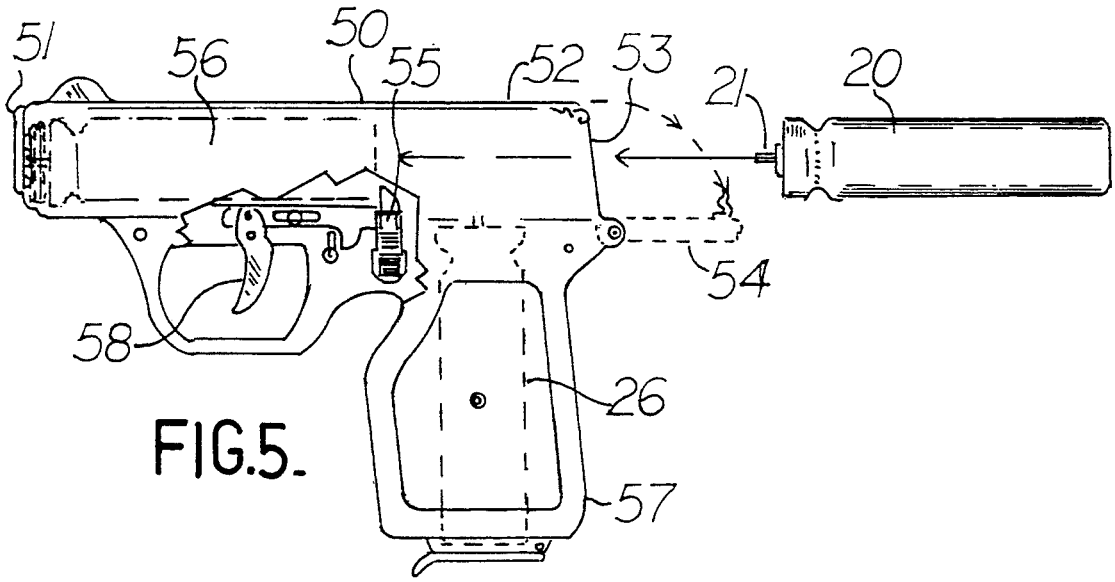
FIG. 5 is a side elevation drawing of the alternative embodiment of the present invention.

FIG. 5 is a side elevation drawing of an alternative embodiment of the present invention. Barrel or barrel means 50, having a shape generally as the barrel of a pistol, has a discharge end 51 and a loading end 52. Canister 20 is loaded through loading aperture 53 normally covered by hinged breech cover 54. Canister 20 is inserted into barrel 10 until it is retained by a canister engagement means such as spring-biased pawl 55 as shown in canister position 56. Spare canister 26 is stored in handle 57 as described earlier. Handle 57 has a shape generally as a handle of a pistol for holding and aiming the device.

Figure 6:
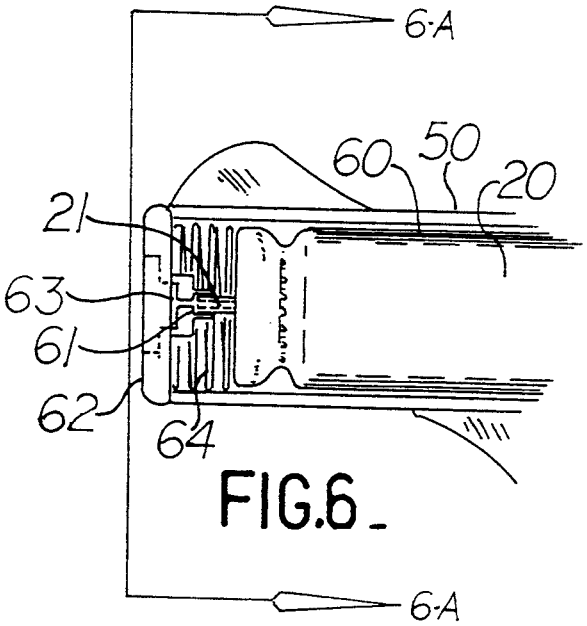
FIG. 6 is a detail elevation drawing of the discharge end of the barrel of FIG. 5.

FIG. 6 is an detail elevation drawing of the discharge end 51 of barrel 50. Canister 20 is inserted into the sliding means or barrel chamber 60 until nozzle valve 21 is seated in nozzle aperture 61 of nozzle valve stop means or nozzle stop 62. Canister 20 stops due to bias of spring 64 and the bias of nozzle valve 21. Discharge aperture 63 provides a discharge path for the canister gas when nozzle valve 21 is depressed.

Figure 6A:
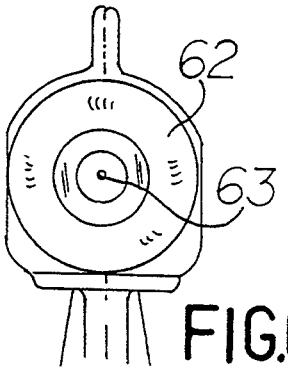
FIG. 6A is a front view of FIG. 6.

FIG. 6A is a front cross-section of FIG. 6 showing nozzle valve stop 62 and nozzle aperture 63.

Figure 7:
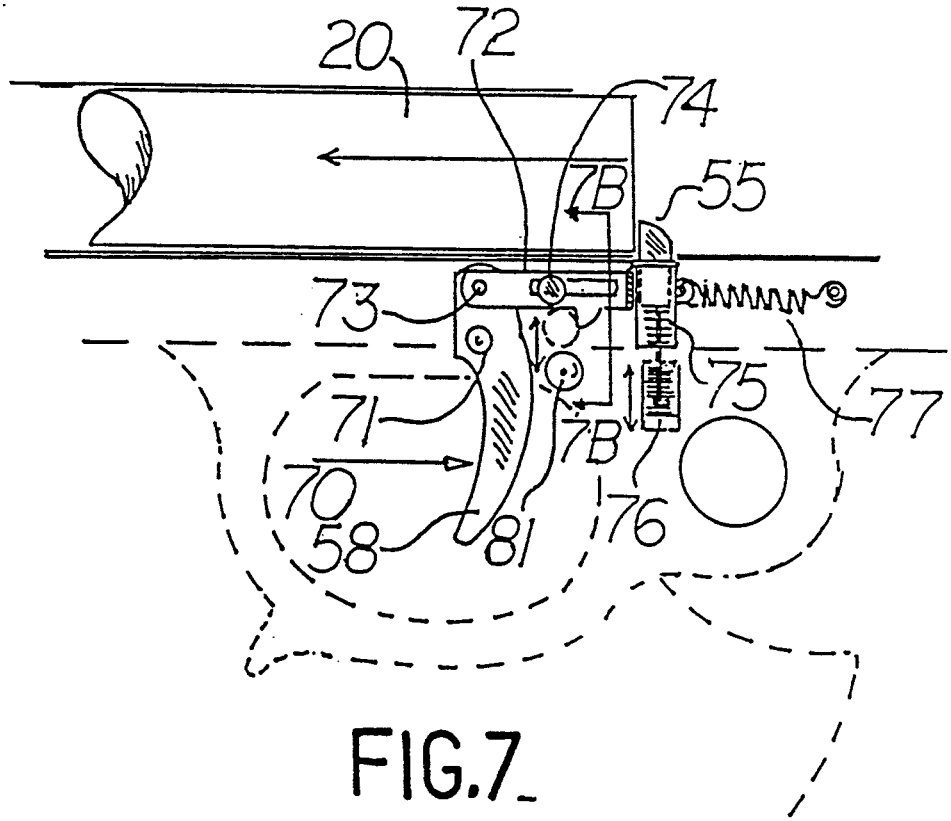
FIG. 7, is a detail elevation drawing of the trigger and canister latch of FIG. 5.

FIG. 7 is a detail elevation of trigger 58 and canister latch 55. Trigger 58 is pivotally mounted to the barrel at pivot 71. A second connection means such as trigger connector 72 is connected to trigger 58 at pivot 73 and to canister latch pawl 55. Trigger connector 72 is allowed to slide longitudinally or pivot at pin 74. When trigger 58 is pulled in direction 70, trigger connector 72 pulls canister latch pawl 55 which pushed canister 20 toward the discharge end. Because nozzle valve 21 is retained by nozzle stop 62, nozzle valve 21 is depressed, discharging the contents.

Pawl spring 75 is compressed when latch pawl 55 is depressed by the insertion of canister 20, or by lowering canister release means or canister release 76. Lowering of canister release 76 disengages latch pawl 55 from canister 20, allowing removal of canister 20 through loading aperture 53. Spring 64 aids in ejection of canister 20. The strong bias of latch spring 77 retains latch pawl 55 in the loading end position during insertion of canister 20, but allows motion of canister latch pawl 55 toward the discharge end when trigger 58 is pulled.

Figure 7A:
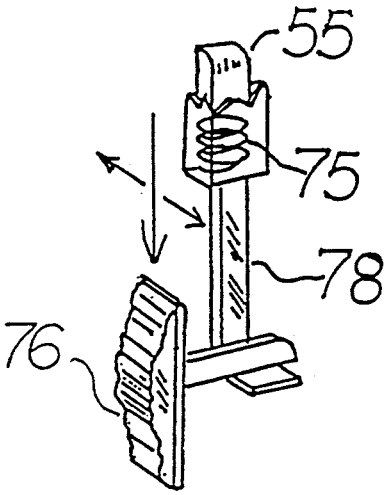
FIG. 7A is a detail perspective drawing of the canister release of FIG. 7.
Figure 7B:
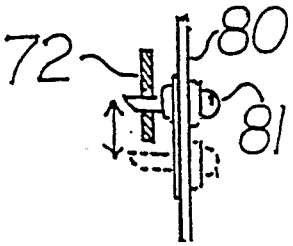
FIG. 7B is a detail cross-section of the safety of FIG. 7.

Detail perspective 7A shows canister release 76 which is slidably mounted on barrel 50. Canister release 76 engages pawl connector 78 which is connected to latch pawl 55. Latch pawl 55 is able to move toward the discharge or loading end as indicated in FIG. 7A.

Safety 81 can be raised as shown in FIG. 7 to prevent trigger connector 72 from moving towards the discharge end. Safety 81 in the raised position will prevent trigger 58 from being pulled and discharging canister 20. Detail section 7B shows safety 81 slideably attached to trigger housing 80, raised to engage trigger connector 72. As an alternative, a connector and canister safety stop could be included to prevent canister 20 from moving toward the discharge end when the safety is engaged.

Accordingly the reader will see the present invention provides a personal protection device which utilizes a non-lethal gas cartridge. The device can be aimed and discharged quickly and accurately. The device comprises the following additional advantages:

- it is simple and can be manufactured at low cost,
- it can be loaded and unloaded quickly and easily,
- a spare gas canister may be stored quickly and conveniently, and
- a safety is included to prevent accidental discharging of the device.

Although the description above contains many specifications, these should not be construed as limiting the scope of the invention but as merely providing illustrations of some of the presently preferred embodiments of this invention. For example, the barrel may comprise a removable or slideable top cover to allow access for loading a canister. Or, a case or holster may be provided to be used in place of, or in addition to, the safety to prevent inadvertent discharge of the device. etc.

Thus the scope of the invention should be determined by the appended claims and their legal equivalents, rather than by the examples given.

I claim:

1. A personal protection device comprising: a barrel means for receiving a pressurized canister of non-lethal gas, the canister having an integral nozzle valve at an end, and the barrel means being generally shaped as a barrel of a pistol and comprising a loading end and a discharge end and retaining the canister so that the integral nozzle valve is directed out the discharge end of the barrel means; a trigger means for activating the integral nozzle valve of the canister; a handle means for holding and aiming the barrel means, the handle means being generally shaped as the handle of a pistol; and a pivot means for attaching the handle means to the barrel means, the pivot means allowing the barrel to be pivoted about the handle to define an operating position and a loading position, and wherein in the loading position, the loading end of the barrel means is exposed for inserting the canister.

2. A device as in claim 1 additionally comprising a canister stop which restrains the canister when the barrel is in the operating position.

3. A device as in claim 1 additionally comprising a safety means for preventing the trigger means from being pulled inadvertently and discharging the canister.

4. A device as in claim 1 additionally comprising a storage chamber in the handle means, the storage chamber being of a size sufficient for storage of a spare canister in the handle means.

5. A device as in claim 4 wherein the storage chamber comprises a nozzle valve receiving means for preventing the nozzle valve from being depressed and discharging the canister, and a storage chamber cover means for covering the storage chamber.

6. A personal protection device comprising: a barrel means for receiving a pressurized canister of non-lethal gas, the canister having an integral nozzle valve at an end and the barrel means being generally shaped as a barrel of a pistol and comprising a loading end and a discharge end and retaining the canister so that the integral nozzle valve is directed out the discharge end of the barrel means; a spring biased latching pawl, the latching pawl engaging the canister when the canister is inserted into the loading end of the barrel means: a trigger means connected the latching pawl for activating the integral nozzle valve of the canister; and a handle means for holding and aiming the barrel means, the handle means attached to the barrel means and being generally shaped as the handle of a pistol.

7. A device as in claim 6 additionally comprising a canister release means, the release means retracting the spring biased pawl to release the canister and allow the canister to be removed through the loading aperture of the barrel,

8. A device as.in claim 6 additionally comprising a safety means for preventing the trigger means from being pulled and Inadvertently discharging the canister.

9. A device as in claim 6 additionally comprising a storage chamber in the handle means, the storage chamber being of a size sufficient for storage of spare canister in the handle means.

10. A device as in claim 9 wherein the storage chamber comprises a nozzle valve receiving means for preventing the nozzle valve from being depressed and discharging the canister, and a storage chamber cover means for covering the storage chamber.

* * * * *